US011371325B2

(12) United States Patent
Chochua et al.

(10) Patent No.: US 11,371,325 B2
(45) Date of Patent: Jun. 28, 2022

(54) AUTONOMOUS INFLOW CONTROL DEVICE

(71) Applicant: Schlumberger Technology Corporation, Sugar Land, TX (US)

(72) Inventors: Gocha Chochua, Sugar Land, TX (US); Aleksandar Rudic, Rosharon, TX (US); Vadim Blekhman, Bellaire, TX (US); Amrendra Kumar, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 53 days.

(21) Appl. No.: 16/954,309

(22) PCT Filed: Dec. 17, 2018

(86) PCT No.: PCT/US2018/065928

§ 371 (c)(1),
(2) Date: Jun. 16, 2020

(87) PCT Pub. No.: WO2019/125993

PCT Pub. Date: Jun. 27, 2019

(65) Prior Publication Data

US 2021/0087910 A1 Mar. 25, 2021

Related U.S. Application Data

(60) Provisional application No. 62/599,996, filed on Dec. 18, 2017.

(51) Int. Cl.
*E21B 43/12* (2006.01)
*E21B 43/08* (2006.01)
(Continued)

(52) U.S. Cl.
CPC ..... *E21B 43/12* (2013.01); *E21B 43/08* (2013.01); *E21B 34/08* (2013.01); *E21B 43/14* (2013.01)

(58) Field of Classification Search
CPC ..... E21B 43/12; E21B 43/08; E21B 43/14; E21B 34/08; E21B 34/06; F16K 25/00;
(Continued)

(56) References Cited

U.S. PATENT DOCUMENTS 4,249,575 A * 2/1981 Syred ..... F15C 1/16 137/812
8,291,976 B2 10/2012 Schultz et al.
(Continued)

FOREIGN PATENT DOCUMENTS

CN 103806881 A 5/2014
RU 98469 U1 10/2010
(Continued)

OTHER PUBLICATIONS

International Search Report and Written Opinion issued in the PCT Application PCT/US2018/065928, dated Apr. 1, 2019 (9 pages).
(Continued)

*Primary Examiner* — George S Gray
(74) *Attorney, Agent, or Firm* — Matthew Goode

(57) ABSTRACT

A technique facilitates improved control over inflowing fluids with respect to, for example, a screen assembly or screen assemblies of a tubing string deployed in a wellbore. The improved control may be provided by at least one inflow control device comprising a housing defining a chamber having a first end and a second end through which fluid may flow. Additionally, the inflow control device comprises at least one inlet passage disposed at the first end and having a contour which provides a desired effect on the inflowing fluid according to the type of fluid, e.g. according to the
(Continued)

viscosity of the fluid. The contour may comprise an expanding cross-sectional area, e.g. a cone or other expanding shape. In some embodiments, the entrance of the inlet passage may have a rounded edge to, for example, create an initially decreasing and then increasing cross-sectional area along the inlet passage.

17 Claims, 5 Drawing Sheets

(51) Int. Cl.
*E21B 34/08* (2006.01)
*E21B 43/14* (2006.01)

(58) Field of Classification Search
CPC .. F16K 25/005; F16K 11/02; Y10T 137/2115; Y10T 137/2087; Y10T 137/2098; Y10T 137/2104; Y10T 137/2065; Y10T 137/2109; Y10T 137/2506; Y10T 137/2093
See application file for complete search history.

(56) References Cited

U.S. PATENT DOCUMENTS

| | | | | |
|---|---|---|---|---|
| 8,714,266 | B2 | 5/2014 | Dykstra et al. | |
| 8,931,566 | B2 | 1/2015 | Dykstra et al. | |
| 9,316,095 | B2 | 4/2016 | Holderman | |
| 2012/0145385 | A1* | 6/2012 | Lopez | E21B 43/12 166/263 |
| 2012/0152527 | A1* | 6/2012 | Dykstra | E21B 28/00 166/223 |
| 2014/0246206 | A1 | 9/2014 | Least et al. | |
| 2016/0160616 | A1* | 6/2016 | Moen | F16K 25/005 166/244.1 |
| 2016/0215598 | A1 | 7/2016 | Lopez et al. | |

FOREIGN PATENT DOCUMENTS

| | | | |
|---|---|---|---|
| WO | 2016090261 | A1 | 6/2016 |
| WO | 2017053335 | A1 | 3/2017 |

OTHER PUBLICATIONS

International Preliminary Report on Patentability issued in the PCT Application PCT/US2018/065928, dated Jul. 2, 2020 (6 pages).

* cited by examiner

AUTONOMOUS INFLOW CONTROL DEVICE

CROSS-REFERENCE TO RELATED APPLICATION

The present document is based on and claims priority to U.S. Provisional Application Ser. No. 62/599,996, filed Dec. 18, 2017, which is incorporated herein by reference in its entirety.

BACKGROUND

In many hydrocarbon well applications, downhole tubing strings include sand screen assemblies to filter inflowing well fluid. The sand screen assemblies may be mounted about a base pipe and positioned in well zones along a wellbore. A plurality of inflow control devices may be used to control flow of the well fluid to an interior of the base pipe at the well zones distributed along the wellbore. Inflow control devices can be used to help equalize inflow of fluid into the base pipe and can also help delay breakthrough of unwanted fluids into the base pipe. However, existing inflow control devices have limitations with respect to equalizing inflow and limiting breakthrough of certain unwanted fluids, e.g. multiphase fluids, when such fluids flow into the sand screen assemblies.

SUMMARY

In general, a system and methodology are provided to facilitate improved control over inflowing fluids. According to embodiments, an inflow control device enhances the ability to delay or prevent breakthrough of unwanted fluids, e.g. gas and/or water which may be found in multiphase fluids, and also to limit inflow of the unwanted fluid if breakthrough occurs. By way of example, one or more of the inflow control devices may be used in cooperation with a screen assembly or screen assemblies of a tubing string deployed in a wellbore. In some embodiments, however, the inflow control devices may be used along completion tubing without sand screens. The inflow control device may comprise a housing defining a chamber having a first end and a second end. Additionally, the inflow control device comprises at least one inlet passage disposed at the first end and having a contour which provides a desired effect on the inflowing fluid according to the type of fluid. (The type of fluid may vary according to the viscosity of the fluid, density of the fluid, or other fluid characteristics.) By way of example, the contour may have a cross-sectional dimension which changes to provide an increasing cross-sectional area. The expanding cross-sectional area may be in the form of a cone or other expanding shape. In some embodiments, the entrance of the inlet passage may have a rounded edge to, for example, create an initially decreasing and then increasing cross-sectional area along the inlet passage.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
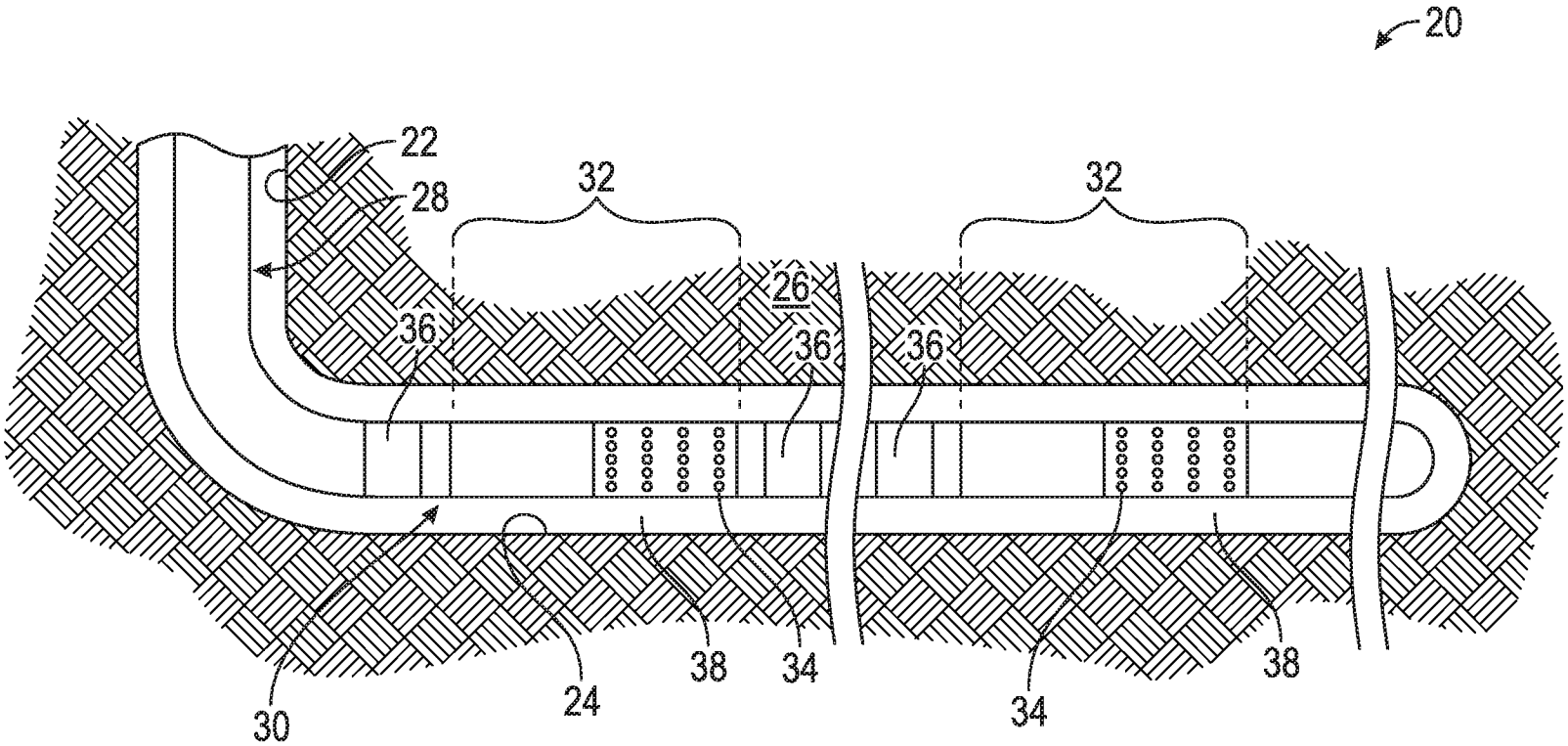
FIG. 1 is a schematic illustration of a well system comprising a well tubing string having screen assemblies deployed in a deviated section, e.g. a horizontal section, of a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate improved control over fluid flow in, for example, a variety of well applications. According to embodiments, an inflow control device enhances the ability to delay or prevent breakthrough of unwanted fluids such as gas and/or water which may be found in multiphase fluids. The inflow control device can also reduce the inflow of unwanted fluid if breakthrough occurs. In a well application, one or more of the inflow control devices may be used in cooperation with a screen assembly or screen assemblies of a tubing string deployed in a wellbore. For example, well fluid may flow from a formation and into a wellbore at a given well zone. The well fluid continues to flow into a screen assembly and then through an inflow control device to an interior of a tubing string base pipe for delivery to a collection location.

Each inflow control device may comprise a housing defining a chamber through which fluid flows, the chamber having a first end and a second end. Additionally, the inflow control device comprises at least one inlet passage disposed at the first end and having a contour, e.g. a changing cross-sectional dimension, which provides a desired effect on the inflowing fluid according to the type of fluid, e.g. according to the viscosity of the fluid. By way of example, the cross-sectional dimension may provide an expanding cross-sectional area. The expanding cross-sectional area may be in the form of a cone or other expanding shape. In some embodiments, the entrance of the inlet passage may have a rounded edge to, for example, create an initially decreasing and then increasing cross-sectional area along the inlet passage.

Inflow control devices may be used in a variety of downhole well completion equipment and downhole applications. For example, inflow control devices may be used in downhole production sections to equalize flow depletion in horizontal wells. In such wells, coning of the oil/water and/or oil/gas interface can lead to premature breakthrough of the "unwanted fluids," e.g. gas and/or water at certain zones.

The breakthrough of gas and/or water can be undesirable for a variety reasons. For example, gas and water can play important roles when left in place in the surrounding formation. Due to its high compressibility, gas may have a high stored energy, which can serve as a driver to displace oil in the formation. Water, on the other hand, helps to lift the oil and deliver it into the wellbore.

Gas and/or water have relatively high mobilities, which can lead to their breakthrough at various sections of the completion equipment and this in turn, can reduce the "push" on the oil in the formation. Embodiments of the inflow control devices described herein may be used to limit the undesirable breakthrough of gas into the completion equipment. Additionally, embodiments of the inflow control devices may be constructed for use in providing flow resistance when encountering multiphase fluids and/or single phase fluids.

Because both water and gas have lower viscosity than oil, these fluids are able to flow through the formation with less resistance than oil under the same or similar reservoir conditions. Consequently, the water and/or gas can begin to dominate the volume fraction of the produced mixture, thus placing additional burden on recycling systems and on-ground separators. This can lead to premature abandonment of partially depleted reservoirs having relatively large percentages of oil unproduced. However, inflow control devices may be utilized along the downhole tubing string, e.g. along downhole well completion equipment, to equalize production between the zones or sections of the downhole tubing string for a variety of inflowing fluid types. Consequently, the percentage of oil that can be recovered is increased.

In porous formation media, fluid flow resistance linearly depends on viscosity and velocity as described by Darcy's law. However, inflow control devices can be designed to generate turbulent jet flow which makes the flow resistance nearly independent of the viscosity and proportional to the density times flow velocity squared (as described by Bernoulli's equation). As a result, if gas and/or water breakthrough occurs in a given section of the downhole tubing string, flow in that section becomes hydrodynamically "choked" by the corresponding inflow control device with resistance proportional to the flow velocity squared. Individual inflow control devices are thus capable of choking low viscosity fluids, such as gas and/or water, while providing lower resistance to higher viscosity fluids such as crude oil.

Embodiments of inflow control devices described herein serve to enhance and improve the capability of controlling inflow of unwanted fluids, e.g. gas and/or water, to thus achieve longer well life and better oil recovery. The inflow control devices may be constructed to be autonomous and to operate over long periods without electrical power and without communication from the surface. In many applications, the inflow control devices are sized to fit in an annular space between a base pipe and a screen of a corresponding screen assembly.

As described in greater detail below, inflow control devices may be "tuned" to provide desired flow control effects. For example, inlet passages of the inflow control device may be constructed with appropriate shapes to provide an increased flow resistance to certain multiphase fluids. Such devices may be used to start choking the inflow of gas and/or water at lower unwanted fluid volume fractions during inflow of multiphase mixtures.

Referring generally to FIG. 1, a well system 20 is illustrated as comprising a wellbore 22 having a deviated wellbore section 24 extending into a formation 26 containing hydrocarbon fluids. Depending on the application, the wellbore 22 may comprise one or more deviated wellbore sections 24, e.g. horizontal wellbore sections, which may be cased or un-cased. In the example illustrated, a tubing string 28 is deployed downhole into wellbore 22 and comprises a downhole well completion 30 deployed in the deviated, e.g. horizontal, wellbore section 24.

The downhole well completion 30 may be constructed to facilitate production of well fluids and/or injection of fluids. By way of example, the downhole well completion 30 may comprise at least one screen assembly 32, e.g. a plurality of screen assemblies 32. Each screen assembly 32 may comprise a sand screen 34 through which fluid may enter the corresponding screen assembly 32 for production to a suitable location, e.g. a surface location. For example, hydrocarbon well fluids may flow from formation 26, into wellbore 22, and into the screen assemblies 32 via sand screens 34. In some embodiments, the downhole well completion 30 also may comprise a plurality of packers 36 which may be used to isolate sections or zones 38 along the wellbore 22.

Figure 2:
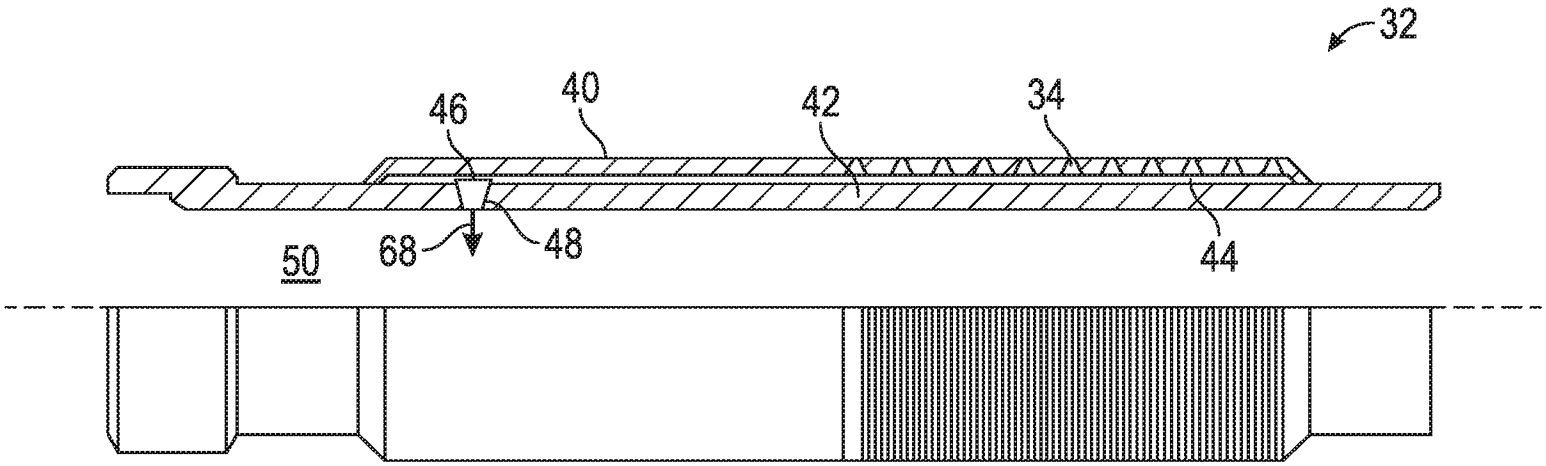
FIG. 2 is partially cut away view of an example of one of the screen assemblies illustrated in FIG. 1, according to an embodiment of the disclosure.

Referring generally to FIG. 2, an example of one of the screen assemblies 32 is illustrated as having sand screen 34 extending longitudinally from a solid section 40. The sand screen 34 and corresponding solid section 40 may be annular in shape and positioned about a base pipe 42, thus creating an annulus 44 therebetween. The sand screen 34 and the solid section 40 may be secured to base pipe 42 at attachment ends or via other suitable attachment mechanisms to mount the sand screen 34 and solid section 40 about the base pipe 42. The base pipe 42 may comprise sections which are coupled together to form the overall well completion 30 with multiple screen assemblies 32.

An inflow control device 46 may be positioned along the base pipe 42 at each screen assembly 32. However, other numbers and arrangements of inflow control devices 46 may be employed depending on the parameters of a given production operation or other well related operation. By way of example, each inflow control device 46 may be positioned in communication with a base pipe passage 48 extending to an interior 50 of the base pipe 42. In this manner, the inflow control device 46 may be used to control flow between annulus 44 and interior 50 of base pipe 42. In some embodiments, the inflow control devices 46 may be used along completion tubing without sand screens to similarly control flow of fluid to an interior of the completion tubing.

According to an example, the inflow control device 46 may be mounted in annulus 44 and positioned such that fluid flowing into the corresponding screen assembly 32 via sand screen 34 flows through the inflow control device 46 before entering interior 50 of base pipe 42. The fluid entering interior 50 may be produced to the desired collection location.

Figure 3:
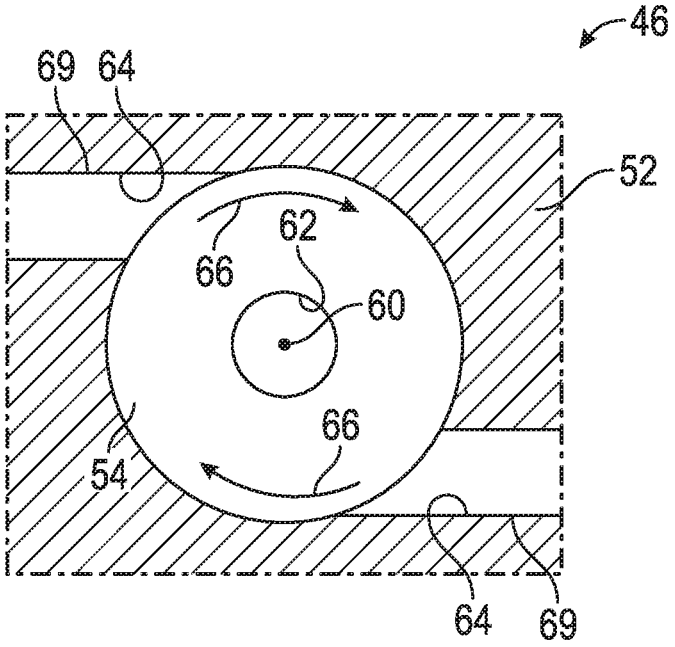
FIG. 3 is a transverse, cross-sectional view of an example of an inflow control device, according to an embodiment of the disclosure.
Figure 4:
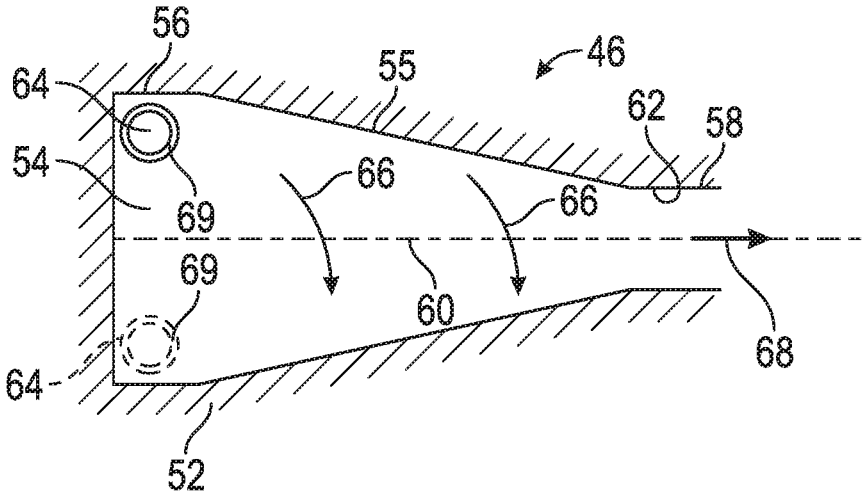
FIG. 4 is an axial, cross-sectional view of the inflow control device illustrated in FIG. 3, according to an embodiment of the disclosure.

Referring generally to FIG. 3, a schematic example of inflow control device 46 is illustrated in a transverse, cross-sectional view. Additionally, FIG. 4 provides a schematic illustration of the same inflow control device 46 in an axial, cross-sectional view. According to the illustrated embodiment, the inflow control device 46 comprises a housing 52 defining a chamber 54 which may have a region 55 of decreasing cross-sectional area along a length between a first end 56 and a second end 58. By way of example, the chamber 54 may be conical, e.g. frustoconical, with the cross-sectional area decreasing along a longitudinal axis 60 extending from first end 56 to second end 58.

The inflow control device 46 further comprises an outlet 62 disposed at the second end 58 of the chamber 54. The outlet 62 is in fluid communication with base pipe passage 48 and thus interior 50 of base pipe 42. Additionally, the inflow control device 46 comprises at least one inlet passage 64, e.g. a plurality of inlet passages 64, disposed at the first end 56 of chamber 54. In the illustrated example, two inlet passages 64 are positioned proximate first end 56.

The at least one inlet passage 64 has a cross-sectional dimension and is configured to inject a flow of fluid, e.g. a jet of fluid, into the chamber 54 at first end 56 when fluid flows through inlet passage 64 and into chamber 54. Each inlet passage 64 is adapted to enable injection of the fluid into chamber 54 such that a fluid flow is produced inside chamber 54 which rotates and translates in a direction along the length of chamber 54 and toward outlet 62, as indicated by arrows 66. By way of example, the outlet 62 may be oriented in line with axis 60 so that fluid discharged through outlet 62 in the direction of arrow 68 travels to base pipe passage 48 and then to base pipe interior 50.

However, the inlet passage(s) 64 may be oriented laterally with respect to axis 60, as illustrated, to facilitate the rotating and translating motion of the fluid indicated by arrows 66. Additionally, the inlet passages 64 may be offset with respect to the axis 60 and with respect to each other, as illustrated. The offset positioning of inlet passages 64 further facilitates initiation of the rotating motion of the fluid as the fluid moves along chamber 54.

To achieve desired effects with respect to resisting flow of specific types of fluids through the inflow control device 46, the shapes of the inlet passages 64 may be "tuned" to restrict the inflow of specific fluids, e.g. multiphase fluids having a given fraction/percentage of gas and/or water. For example, each inlet passage 64 may be shaped with a contour 69 having an increasing cross-sectional area in the direction of fluid flow.

Figure 5:
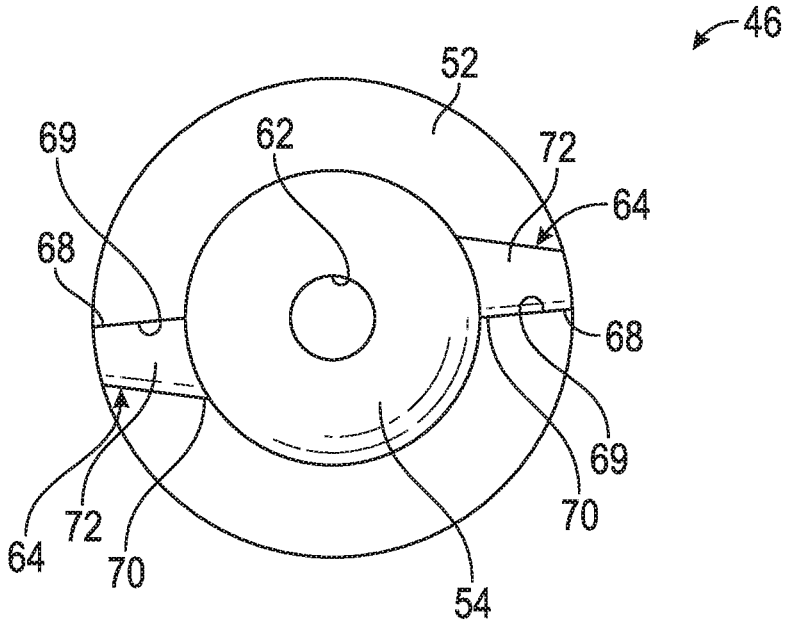
FIG. 5 is an axial cross-sectional view of another example of an inflow control device, according to an embodiment of the disclosure.

With additional reference to FIG. 5, an embodiment of the inflow control device 46 is illustrated in which each inlet passage 64 has a cross-sectional dimension which increases moving from an entrance 68 to an exit 70 of the inlet passage 64. For example, the contour 69 of inlet passage 64 may be formed in a conical shape with an expanding cross-sectional area moving from entrance 68 to exit 70. The expanding cross-sectional area is particularly useful for restricting the inflow of multiphase fluid mixtures containing a low-density phase, e.g. gas and/or water.

With respect to multiphase mixtures, such mixtures tend to have substantial surface tension in downhole conditions and drops or bubbles of the secondary phase tend to form in the primary phase. Formation of the drops/bubbles results in phase separation in the rotating flows in chamber 54. The separation of phases effectively makes the discharge coefficient of the mixture higher compared to the homogeneous flow performance. The discharge coefficient may be provided by the following equation:

$$C_d = \frac{Q}{A}\sqrt{\frac{\rho_{mix}}{2\Delta p}} \tag{1}$$

The multiphase flow density in this equation (1) represents the homogeneous mixture density:

$$\rho_{mix}=\alpha_o\rho_o+\alpha_w\rho_w+\alpha_g\rho_g \tag{2}$$

In the latter equation, $\alpha_o$, $\alpha_w$, and $\alpha_g$ are the volume fractions of the free oil, water, and gas phases, respectively. By forming inlet passages 64 with an increasing cross-sectional area, the fluid is rendered more homogeneous inside the inflow control device 46.

According to an embodiment, a pair of inlet passages 64 are employed and each inlet passage 64 may be formed as a conical diffuser 72 with expanding cross-sectional area. Additionally, the inlet passages 64 are oriented in a direction opposing each other at a given offset with respect to each other on opposite sides of axis 60, as illustrated in FIG. 5. The offset helps provide a swirling flow in chamber 54 as multiphase fluid enters through inlet passages 64. The swirling flow within inflow control device 46 separates liquid and forms a liquid film along the walls of chamber 54. The liquid film is then re-entrained by the incoming multiphase fluid flowing through the conical diffusers 72 of inlet passages 64, thus making the mixture effectively heavier. As a result, a higher pressure loss is generated for gas mixtures and the desired flow restriction is achieved for such multiphase mixtures.

Figure 6:
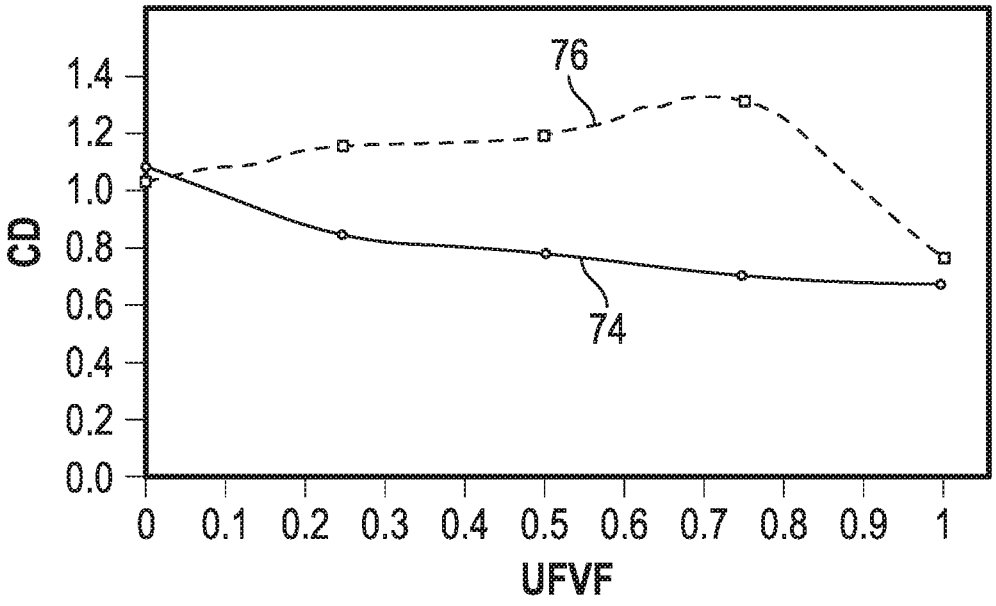
FIG. 6 is a graphical illustration showing different performance characteristics of inflow control devices, according to an embodiment of the disclosure.

As illustrated graphically in FIG. 6, the conical diffusers 72 begin to react to the presence of gas and/or water at low unwanted fluid volume fractions (UFVFs) and they hold this advantage all the way to a UFVF equal to approximately 1 (see graph line 74). For comparison, the graph in FIG. 6 also includes graph line 76 which illustrates an example of the coefficient $C_d$ when fluid flow moves through inlet passages which are cylindrical in shape rather than having the illustrated expanding conical shapes. An example of inflow control devices which utilize cylindrical inlets may be found in the related patent application US 2016/0160616 A1, the contents of which are incorporated herein by reference in their entirety. For further comparison, use of simple orifices in place of inlet passages 64 would result in a relatively constant $C_d$ of approximately 1.0. It should be noted the conical diffusers 72/inlet passages 64 also function to restrict inflow of fluid having a percentage of water, e.g. a high water cut.

Figure 7:
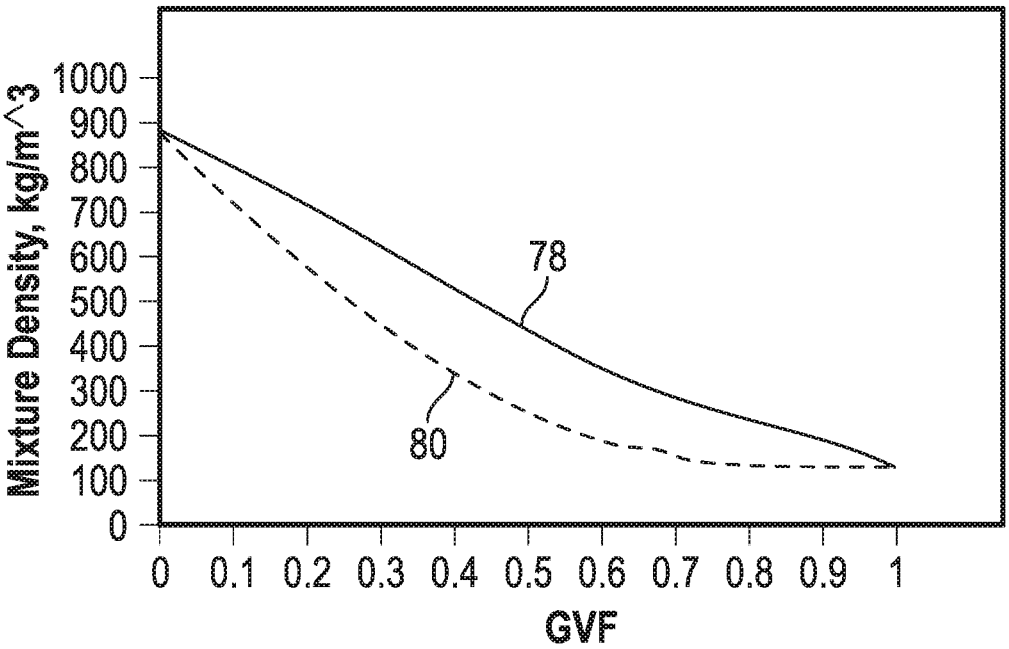
FIG. 7 is a graphical illustration comparing unwanted fluid volume fraction (e.g., gas volume fraction and/or water volume fraction) versus mixture density of fluid moving through the inflow control devices, according to an embodiment of the disclosure.

As further illustrated in the graph of FIG. 7, the opposed, offset conical diffusers 72 of inlet passages 64 make a decrease of the mixture density with the growth of GVF more gradual, i.e. the flow is more homogeneous (see graph line 78). For comparison, the graph in FIG. 7 also includes graph line 80 which illustrates an example of changes in mixture density when fluid flow moves through inlet passages which are cylindrical in shape rather than having the illustrated expanding conical shapes. A similar trend occurs with respect to mixture viscosity.

Figure 8:
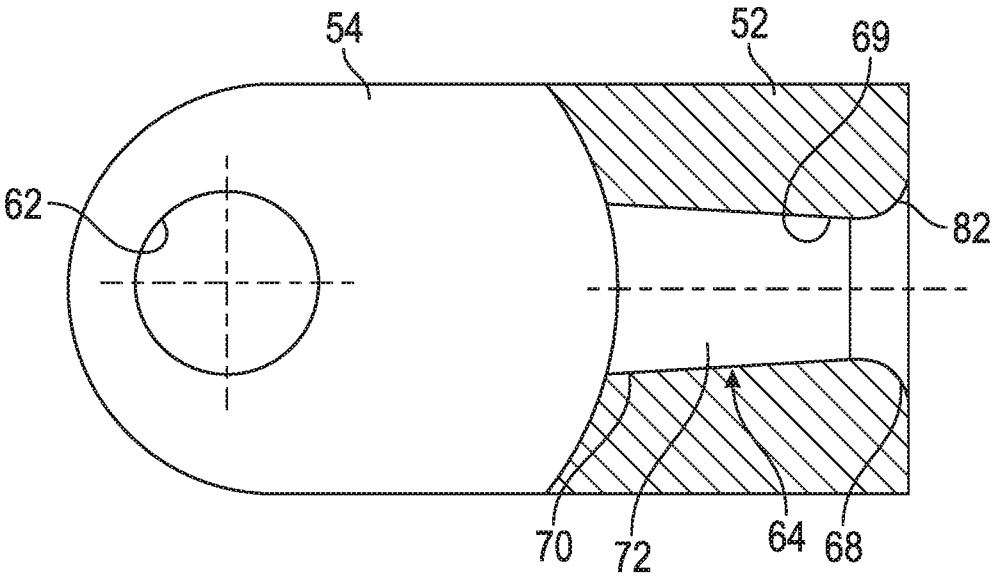
FIG. 8 is an illustration of another example of an inflow control device having different fluid flow control characteristics, according to an embodiment of the disclosure.

It should be noted the contours and shapes of inlet passages 64 may be adjusted to achieve different effects with respect to controlling inflow of unwanted fluids. Referring generally to FIG. 8, for example, an embodiment is illustrated in which the entrance 68 of each inlet passage 64 is provided with a rounded edge 82. It is been found that sharp entrance edges can create a so-called "vena contracta" effect which, in some applications, can reduce device performance.

In the embodiment illustrated, the rounded edge 82 of entrance 68 is combined with conical diffuser 72 to form a Venturi type inlet passage 64. In other words, each inlet passage 64 is constructed with a cross-sectional area which initially gradually decreases and then increases in the direction of fluid flow. The rounded edges 82 create a contour 69 which gradually forces the flowing fluid to a reduced cross-sectional area before the cross-sectional area is increased as the fluid flows along the conical diffuser portion 72 of the inlet passage 64. The use of rounded edges 82 combined with conical diffusers 72 helps the inflow control device 46 to resist both the flow of multiphase fluids when the fraction or percentage of gas (or water) rises above a given level and also the flow of unwanted single phase fluid, e.g. gas and/or water.

In many downhole production applications, the downhole well completion incurs unwanted fluid breakthrough in the form of a multiphase mixture flowing through the device with phases which tend to separate. The use of opposed conical diffusers 72 along inlet passages 64 to create opposing inlet jets with a small offset works well to limit the inflow of undesirable multiphase mixtures. Effectively, the conical diffusers 72 homogenize the fluid mixture inside the inflow control device 46 by re-injecting the separated phases back into the mixture.

As discussed above with reference to FIG. 6, the conical diffusers 72 enable the inflow control device 46 to begin reacting to the presence of gas and/or water at the early stages of breakthrough when the gas fraction is relatively small. The inflow control device 46 is able to continue this resistance to the inflow of gas and/or water as the percentage of gas increases to nearly 100% as represented by the value of 1 on the horizontal axis of the graph in FIG. 6. The rounded entrance edges 82 may be used to facilitate effective resistance to gas and/or water when the gas and/or water content is high, e.g. when the fluid mixture is a single phase or approaches a single phase. In many oil production applications, the ability to automatically choke the gas and/or water at lower UFVFs is very desirable.

It should be noted the contour of the expanding cross-sectional area of each inlet passage 64 may be adjusted to provide the desired effects according to the types of unwanted fluids and the downhole conditions for a given operation. The inlet passages 64 of each inflow control device 46 may be adjusted to help regulate the production of water and/or gas. Similarly, the size and shape of chamber 54 may be adjusted according to the parameters of a given operation.

The shape, size, and contour of the inlet passages 64 also may be selected to restrict the flow of unwanted fluids based on various fluid properties or combinations of fluid properties. Examples of such fluid properties include viscosity, density, flowrate, or other properties of inflowing fluid. The type of fluid which is desirable or undesirable also may change according to the parameters of a given downhole operation. The configuration of the inflow control devices 46 may be adjusted accordingly.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a tubing string deployed in a wellbore, the tubing string comprising a base pipe, a plurality of screen assemblies positioned about the base pipe, and a plurality of inflow control devices positioned along the base pipe in cooperation with the plurality of screen assemblies to control fluid flow into an interior of the base pipe, each inflow control device comprising:

a housing defining a chamber having a first end, a second end, and a length along which a cross-sectional area of the chamber decreases;

an outlet disposed at the second end of the chamber, the outlet being in communication with the interior of the base pipe; and at least one inlet passage in communication with the chamber, the at least one inlet passage comprising a conical diffuser section having a diameter which increases moving from an entrance of the at least one inlet passage to an exit of the at least one inlet passage, the at least one inlet passage being adapted, in response to received fluid, to inject a flow into the chamber near the first end of the chamber such that a fluid flow is produced inside the chamber that rotates and translates in a direction along the length of the chamber toward the outlet.

2. The system as recited in claim 1, wherein the entrance has a rounded edge.

3. The system as recited in claim 1, wherein the at least one inlet passage comprises a pair of inlet passages.

4. The system as recited in claim 3, wherein the inlet passages of the pair of inlet passages are offset from each other to facilitate rotation of the fluid flow in the chamber.

5. The system as recited in claim 4, wherein each inlet passage comprises a conical diffuser section and a rounded edge at the entrance to establish an initially decreasing and then increasing diameter along each inlet passage.

6. The system as recited in claim 1, wherein the chamber is conical.

7. The system as recited in claim 1, wherein each inlet passage chokes flow of fluid into the chamber when the fluid is a multiphase fluid containing a given percentage of gas and/or water.

8. The system as recited in claim 1, wherein the tubing string is deployed in a horizontal wellbore section.

9. A system for controlling fluid flow, comprising:

an inflow control device comprising:

a housing defining a chamber having a first end, a second end, and a length along which a cross-sectional area of the chamber decreases;

an outlet disposed at the second end of the chamber; and a plurality of inlet passages in communication with the chamber, each inlet passage comprising a conical diffuser section with a diameter which increases moving from an entrance to an exit of the inlet passage, each inlet passage being adapted, in response to received fluid, to inject a flow into the chamber near the first end of the chamber such that a fluid flow is produced inside the chamber that rotates and translates in a direction along the length of the chamber toward the outlet, the contour being shaped to increase resistance to flow in the presence of specific fluid types, wherein the entrance has a rounded edge.

10. The system as recited in claim 9, wherein the entrance has a rounded edge.

11. The system as recited in claim 9, wherein the inlet passages are offset from each other to facilitate rotation of the fluid flow in the chamber.

12. The system as recited in claim 9, wherein each inlet passage comprises a conical diffuser section and a rounded edge at the entrance to establish an initially decreasing and then increasing circumference along each inlet passage.

13. The system as recited in claim 12, wherein the chamber is conical.

14. The system as recited in claim 9, further comprising a sand screen assembly positioned about a base pipe, the inflow control device being positioned on the base pipe such that the outlet is in communication with an interior of the base pipe.

15. The system as recited in claim 14, wherein the inflow control device comprises a plurality of inflow control devices positioned along the base pipe to limit inflow of gas and/or water into the interior of the base pipe.

16. A method, comprising:

positioning a plurality of inflow control devices along a well tubing string;

forming each inflow control device with a housing defining a chamber having a first end, a second end, and a length along which a cross-sectional area of the chamber decreases; an outlet disposed at the second end of the chamber, the outlet being in communication with the interior of the well tubing string; and a plurality of inlet passages in communication with the chamber;

providing each inlet passage with comprising a conical diffuser section having a diameter which increases moving from an entrance to an exit of the inlet passage; and orienting each inlet passage to inject a received fluid into the chamber near the first end of the chamber such that a fluid flow is produced inside the chamber that rotates and translates in a direction along the length of the chamber toward the outlet.

17. The method as recited in claim 16, further comprising forming the entrance of each inlet passage with a rounded edge.

* * * * *